United States Patent [19]

Hatcher

[11] 4,012,816

[45] Mar. 22, 1977

[54] METHOD AND APPARATUS FOR PROCESSING THERMOPLASTIC YARN

[75] Inventor: Charles S. Hatcher, Greenville, S.C.

[73] Assignee: Phillips Petroleum Company, Bartlesville, Okla.

[22] Filed: June 2, 1975

[21] Appl. No.: 583,318

Related U.S. Application Data

[63] Continuation-in-part of Ser. No. 405,520, Oct. 11, 1973, abandoned.

[52] U.S. Cl. ..... 28/1.3; 28/1.7; 28/72.14

[51] Int. Cl.[2] ..... D02G 1/20; D02G 1/12

[58] Field of Search ..... 28/1.6, 1.7, 72.14, 28/1.3, 72.11; 219/388, 502

[56] References Cited

UNITED STATES PATENTS

| | | | |
|---|---|---|---|
| 3,886,636 | 6/1975 | Borenstein et al. | 28/72.14 X |
| 3,961,401 | 6/1976 | Ferrier et al. | 28/1.3 |
| 3,961,402 | 6/1976 | Ferrier et al. | 28/72.14 |

*Primary Examiner*—Louis K. Rimrodt

[57] ABSTRACT

In processing thermoplastic yarn a value is monitored to determine whether said value is above or below a predetermined value. The monitored value is related to the denier of the yarn and associated with a yarn plug. The interval for the monitored value associated with said yarn plug to oscillate with respect to said predetermined value is timed and the yarn is processed in response thereto.

24 Claims, 2 Drawing Figures

METHOD AND APPARATUS FOR PROCESSING THERMOPLASTIC YARN

This application is a continuation-in-part of my copending application, Ser. No. 405,520, filed Oct. 11, 1973 now abandoned.

BACKGROUND OF THE INVENTION

The invention relates to a method and apparatus for processing thermoplastic yarn.

In processing thermoplastic yarn, it is frequently desirable to produce a yarn having increased bulk and cover, improved hand, etc. Several methods of processing yarn have been developed to produce a yarn with these qualities. Some of these processing methods produce a yarn plug such as stuffer box and fluid jet crimping techniques as known in the art. The yarn plug produced by crimping is subsequently broken up and extended to form crimped yarn by various methods such as air, friction, etc., coupled with a high speed takeoff means. The properties of the yarn such as denier, crimp and bulk are usually measured after the processed yarn is wound on packages. Since numerous conditions affecting the yarn can change involuntarily and without notice, the package of yarn is usually deniered to insure that it is within quality control limits. Thus adjustments to the process to bring the properties of the yarn within quality control limits necessarily cannot be made until at least one package of off denier or inferior quality yarn has been produced. It is not unusual to have a time lag of from 1 to 1½ hours between the time when a package of off denier yarn has been produced and the time when it is detected by deniering and adjustments to the process are made. Thus at a production rate of four packages per hour per processing line, four to six off denier packages of yarn can be produced per processing line before the process is corrected.

In addition, deniering the packages of yarn generally wastes 90 meters of yarn per package plus it requires test equipment and personnel to perform that function. This in itself constitutes a significant expenditure over a period of time. Thus, considerable savings in time, money and material could be realized if a process were developed where deniering was not required to insure that the yarn produced was within quality control limits.

It is an object of the invention to provide a method and apparatus for processing thermoplastic yarn.

Another object of the invention is to provide a method and apparatus for processing thermoplastic yarn whereby deniering is not required to insure that the yarn produced is within quality control limits.

SUMMARY

According to the invention there is provided a method for processing thermoplastic yarn comprising: monitoring a value related to the denier of the yarn and associated with a yarn plug to determine whether said value is above or below a predetermined value; timing the interval for the value associated with said yarn plug to oscillate above and below said predetermined value; and processing the yarn in response thereto.

Further in accordance with the invention a thermoplastic yarn is processed by passing the yarn to a heating zone; passing the heated yarn to a texturing zone wherein the textured yarn exits the texturing zone in the form of a yarn plug, said yarn plug having an end from which the textured yarn is pulled, said end oscillating with respect to a predetermined point; controlling the temperature of the heated yarn by controlling the temperature of the heating zone; controlling the temperature of the heating zone by employing a temperature controller which maintains the temperature of the heating zone at first set point; continuously monitoring the presence or absence of said yarn plug at the predetermined point; timing the interval for the end of said yarn plug to oscillate with respect to said predetermined point; comparing the time interval with a fixed time period; and changing the set point of said temperature controller from the first set point to the second set point in response to the comparison of said time interval with said fixed time period.

Further in accordance with the invention there is provided apparatus for processing thermoplastic yarn comprising: a monitoring means to monitor a value related to the denier of said yarn and associated with a yarn plug to determine whether said value is above or below a predetermined value; a timing means to time the interval for the value associated with said yarn plug to oscillate above and below said predetermined value; and means for processing the yarn in response to said time interval.

Further in accordance with the invention an apparatus for processing thermoplastic yarn comprises heating means for heating a yarn; texturing means for texturing the heated yarn to produce a yarn plug, said yarn plug having an end from which the textured yarn is pulled; temperature control means for maintaining the temperature of the heating means at a first set point; monitoring means for monitoring the end of said yarn plug, the end of said yarn plug oscillating with respect to a predetermined point; timing means for timing the interval for the end of said yarn plug to oscillate with respect to said predetermined point; and means for changing the set point of the temperature control means from the first set point to a second set point if the interval for the end of said yarn plug to oscillate with respect to said predetermined point is equal to or longer than a fixed time period.

DETAILED DESCRIPTION OF THE INVENTION

Figure 1:
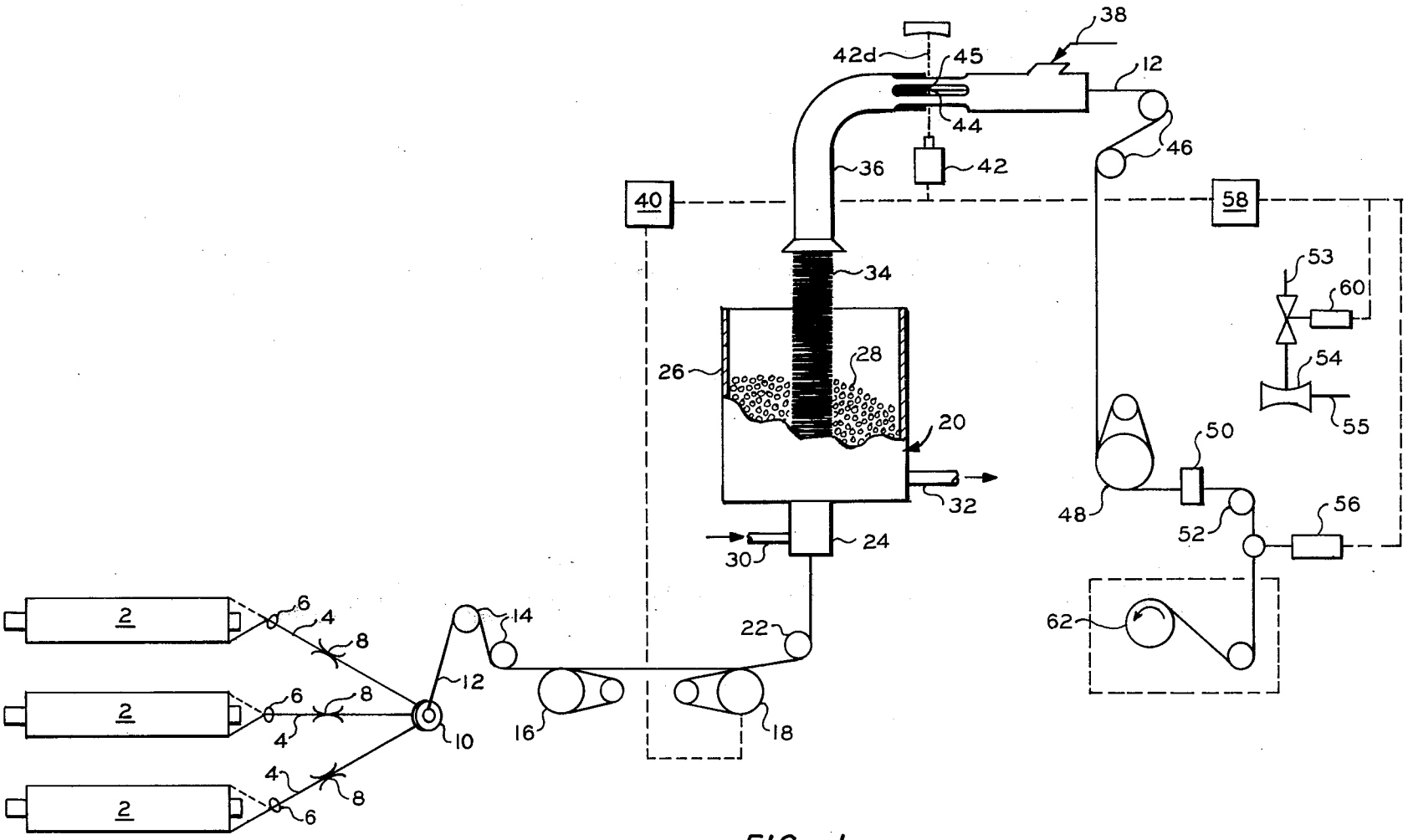
FIG. 1 schematically illustrates an embodiment of the apparatus of the invention employing a cutter and an aspirator for sending the yarn to waste; said apparatus is also suitable for use in one embodiment of the process of the invention.

Referring to the drawing and specifically to FIG. 1, the invention will be more fully explained in a system in which the length of a yarn plug is monitored. Continuous filament undrawn yarn 4 is fed from a plurality of packages 2 through eyelet guides 6 and tensioned by tensioning gates 8 to control the yarn coming from the packages 2. The yarn 4 is brought together in guide 10 to form a yarn 12 of the desired total denier and tensioned by tensioning gate 14 to provide better control of the yarn. The yarn 12 is fed to a heated feed roll 16 and onto a heated draw roll 18. Either or both of these rolls are suitable for use as a heating zone or a heating means. The draw ratio should be the highest ratio consistent with good drawing performance. The yarn is then fed to a suitable crimping means generally denoted by reference numeral 20. In the embodiment illustrated, the crimping means 20 is a fluid jet crimper as known in the art; however, other crimping means such as a stuffer box can be used. The only limitation imposed on the crimping means 20 is that it be of the type which produces a yarn plug. The crimping means 20 contains a fluid jet portion 24 and a chamber 26 containing a plurality of stacked members 28 such as balls. A suitable heating fluid such as steam enters the fluid jet portion 24 of crimper 20 via line 30. The steam heats the yarn 12, assists in crimping and exits the crimper via line 32 and through the stacked members 28. An adjustable angle idler 22 is used to insert a controllable amount of false twist into the yarn prior to crimping. This is useful in controlling heat losses from the yarn, and, hence the yarn temperature entering the crimping means 20. The yarn plug 34 formed in the crimping means 20 is passed through a tube 36 in which the yarn plug 34 is broken up and cooled by countercurrent air 38 or other suitable fluid, producing yarn plug end 45.

The length of the yarn plug 34 in the quench tube 36 varies inversely with the temperature of the yarn in the crimping means 20. Increasing the temperature of the yarn in the crimper causes the yarn to shrink, increasing the denier of the yarn and thus decreasing the yarn plug length. Conversely, decreasing the temperature of the yarn increases the yarn plug length. Temperature controller 40 controls the temperature of draw roll 18 which in turn controls the temperature of the yarn entering the crimping means 20 and consequently the length of the yarn plug. Temperature controller 40 is set to maintain the surface temperature of the draw roll at or above a preset temperature or set point. This temperature controller is of a standard type which senses the resistance of a temperature-sensitive device, such as a metal resistor-bulb. The temperature controller will add heat until it sees a resistance which equals the set point resistance. In addition, a by-pass circuit is contained in the temperature controller 40 which increases the temperature of the draw roll 18 above the set point whenever said by-pass is activated. Since a metal resistor-bulb increases in resistance with increasing temperature, the by-pass circuit merely reduces the actual resistance as seen by the temperature controller causing the temperature controller to heat the roll above the set point. Heat is added to the roll until the resistance of the metal resistor-bulb as modified by the by-pass circuit equals the resistance of the metal resistor-bulb at the set point. Point 44 indicates a point lying on the path of both an electric eye beam **42*a* and the yarn plug 34. Electric eye 42 monitors the length of the yarn plug 34 by detecting the presence or absence of the yarn plug 34 at point 44 and activates the by-pass circuit of the temperature controller 40 if the yarn plug 34 is detected, that is, if beam 42*a* is interrupted by plug 34. The detection of the yarn plug can be accomplished by electrical or mechanical means or both; however, the electric eye works very well and is preferred. Temperature controller 40 then raises the temperature of the draw roll above the set point, increasing the temperature of the yarn and decreasing the yarn plug length. When the electric eye 42 detects the absence of the yarn plug 34 at point 44, then the by-pass circuit is deactivated and temperature controller 44** maintains the temperature of the draw roll at the set point.

In setting the set point of temperature controller 40, the controller should have a set point at which the temperature of the draw roll is maintained so that the end of the yarn plug 45 is positioned just above the electric eye beam **42*a* and point 44, that is, where the plug just breaks the beam. When the electric eye beam 42*a* is broken and the end of the yarn plug 45 is above point 44, the by-pass circuit is activated causing the temperature controller 40 to increase the temperature of the draw roll above the set point. This in turn increases the temperature of the yarn and thus reduces the yarn plug length until the electric eye 42 is exposed to light beam 42*a* indicating that the end of the yarn plug 45 is below point 44. Thus in normal operation the end of the yarn plug 45 must continuously oscillate above and below the electric eye beam 42*a* and point 44.**

The monitored value is normally the length of the yarn plug or the end 45 of yarn plug 34 but some other parameter which is an indicator for changes in yarn denier can be used. If a stuffer box crimper is used as the crimping means, then changes in yarn plug length can be made by changing the gate pressure if desired rather than changing the temperature of the yarn in the crimper; or both the gate pressure and the temperature of the yarn can be controlled. If only the gate pressure is controlled, then temperature controller 40 would be replaced with a pressure controller; however, the electric eye 42 and the by-pass circuit would remain the same.

It is noted that the temperature of the yarn in the crimping means 20 can be adjusted by controlling process variables other than the draw roll temperature. For example, the temperature and/or flow rate of the steam in the fluid jet crimper can be controlled. However, control of the draw roll temperature has proven to be very effective and is preferred.

Further in accordance with the drawing the crimped yarn 12 is tensioned by tension pins 46 and then passed to take off roll 48. Take off roll 48 is operated at a constant speed determined in relation to the speed of draw roll 18 so as to produce yarn of the desired denier.

The yarn 12 is entangled by entangler 50, passed over pin 52 and aspirator 54 and passed through cutter 56. The yarn 12 is subsequently wound on packages by winder 62.

Aspirator 54, cutter 56 and timer 58 are operated in conjunction with the electric eye 42. The electric eye 42 monitors a value which in this embodiment is the length of the yarn plug as indicated by the presence or absence of the yarn plug 34 at point 44 lying on the path of the electric eye beam **42*a*. Each time the beam 42*a* is opened or closed, that is, when the eye 42 detects either the presence or absence of the yarn plug 34, timer 58 is reset. It is only when timer 58 is not reset within a fixed period of time and thus the timer 58 times out that solenoid 60 is triggered, which supplies air via line 53 to aspirator 54, and cutter 56 cuts the yarn. Yarn 12 is then produced to waste via line 55 through the aspirator 56** and the package is doffed.

It is important to emphasize that the electric eye 42 resets timer 58 either when it detects the presence of the yarn plug 34 or when it detects the absence of the yarn plug 34 after once detecting it. Thus timer 58 times the interval for the yarn plug 34 to oscillate from point 44 and back again in either direction. If the time for the oscillation is equal to or longer than the fixed period of time set on the timer, then the timer times out, activating the cutter and aspirator system.

Since the draw roll 18 and the take off roll 48 are operated at constant speeds, the yarn plug 34 could be maintained at a constant length provided the various temperatures throughout the process and the denier of the feed yarn were constant; such a system would always produce constant denier yarn. But, only the speed of the draw roll 18 and the take off roll 48 can be held constant and as other process variables change, the yarn plug 34 will change in length, which also indicates a change in yarn denier. However, it has been discovered that the denier of the yarn produced can be maintained within quality control limits where the yarn plug 34 oscillates above and below a predetermined value within a fixed period of time. It is possible that even though the timer times out, the denier of the yarn produced may still be within quality control limits. This would occur, for example, if the temperature of the steam entering the fluid jet 30 accidentally fell at the same time that the draw roll 18 was increasing in temperature to bring the end of the yarn plug 45 below the electric eye beam 42*a* and the result was that the end of the yarn plug 45 remained just above point 44. Of course, such a situation is highly unlikely, but it is possible. The important thing that must be emphasized, however, is that if the yarn being produced is off-denier, the yarn plug will not be oscillating properly and the timer will time out.

Figure 2:
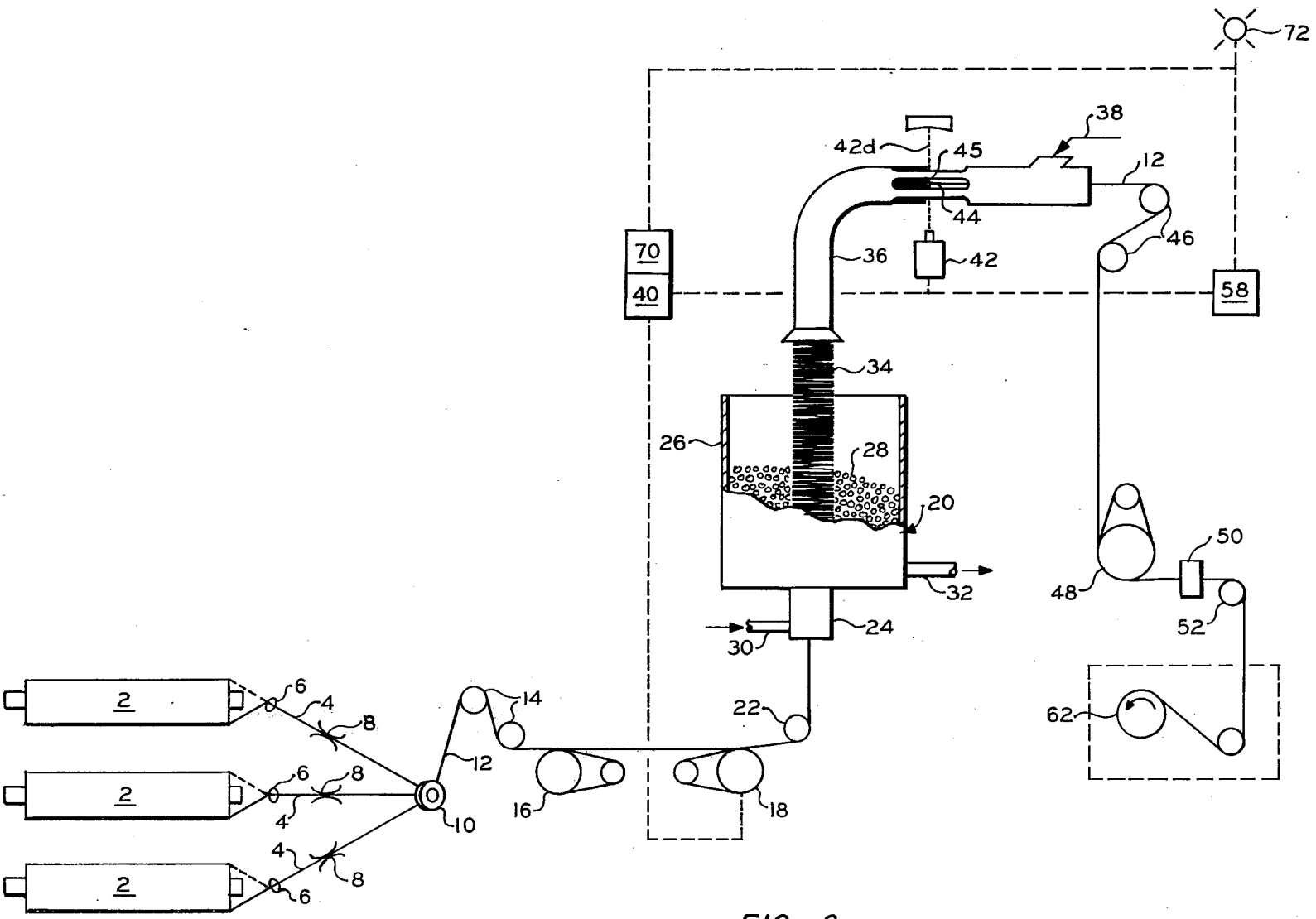
FIG. 2 schematically illustrates another embodiment of the apparatus of the invention which is also suitable for use in another embodiment of the process of the invention.

Although one of the preferred embodiments is to utilize the aspirator and cutter system as described above, the timer can be used to light a light, sound a horn, etc., when timed out; or, as shown in FIG. 2 which is another preferred embodiment, the timer can be used to adjust the set point of the temperature controller. In its broadest aspect the invention is not limited to the use of a particular system or process, such as the cutter and aspirator system, but simply to processing the yarn in response to the time interval required for the yarn plug oscillation.

Referring now to FIG. 2, which shows schematically an embodiment very similar to that of FIG. 1 except that instead of using a cutter 56, aspirator 54, and associated equipment, FIG. 2 uses a means 70 for changing the set point of temperature controller 40 when the timer 58 times out. In some instances it may be desirable to adjust the set point of temperature controller 40 rather than cut the yarn and send it to waste as previously described.

According to this embodiment of the invention as shown in FIG. 2, a signal from timer 54 to set point adjustment means 70 is provided when the timer times out. Where temperature controller 40 senses the resistance of a temperature-sensitive device as previously described, means 70 can be a circuit which increases or decreases the resistance of the set point circuit causing the adjusted set point to be raised or lowered a specified amount as compared to the original set point. Generally the difference between the adjusted or second set point and the first or original set point ranges from about 1° to about 10° C.

In the operation of this embodiment of the invention, if the yarn plug 34 is out of control in the direction of the crimping means 20 when the timer 58 times out, thus indicating the yarn plug 34 is too short, the heating zone, draw rolls 16 and 18, must be operated at a lower temperature. Therefore, set point adjustment means 70 adds resistance to the set point circuit. On the other hand, if timer 58 times out when the plug is out of control in the direction of winder 62, thus indicating that the yarn plug 34 is too long, the heating zone, draw rolls 16 and 18, must be operated at a higher temperature. Therefore, set point adjustment means 70 decreases the resistance of the set point circuit. In addition, indicating means 72, such as a light, can be used to indicate to an operator that the set point of temperature controller 40 is being adjusted and that the operation should be examined to determine why the adjustment to the set point is necessary. Timer 58 can be either manually or automatically reset once the set point is adjusted.

Further the embodiments of FIGS. 1 and 2 can be combined wherein the cutter and aspirator system of FIG. 1 is used after one or more adjustments to the set point are made employing the system of FIG. 2. Such a combined system would permit the operator an opportunity to inspect the equipment while it is operating to determine why the set point was adjusted.

Although it is possible to adjust the set point of the temperature controller repeatedly, employing simple control circuitry well known in the art, it is not recommended to do so if each adjustment is in the same direction, that is, if a number of adjustments in a row decreases the resistance of the set point circuit. For example, if a belt on a draw roll begins to slip, causing the yarn to experience less and less drawing, then repeated adjustments to the set point of the temperature controller to increase the temperature of the draw rolls would probably maintain the denier of the yarn within quality control limits; however, eventually a yarn would be produced which may be of the proper denier but which would not possess the proper crimp. The number of adjustments to the set point which can be tolerated will vary considerably depending upon the magnitude of each adjustment, the specific process, and the type and denier of the yarn processed.

EXAMPLE

Three ends of undrawn poypropylene yarn were processed in accordance with the invention as shown in FIG. 1 and described above. Each end of the feed yarn was 2380/42 denier. It was desired to produce 2500/126 denier yarn with quality control limits of ±100 denier. The by-pass circuit on the temperature controller was set to add a maximum of 6° C to the draw roll and the resettable timer adjusted to 2 minutes.

The electric eye-temperature controller system as described above compensated for changes in process variables, but only to a limited extent. The limit to which the electric eye-temperature controller system compensated for changes in process variables depended upon the temperature range of the by-pass circuit on the temperature controller. The relationship between the temperature of the draw roll and the denier of the crimped polypropylene yarn of the size used was approximately 27 denier per ° C. Thus with the by-pass circuit set at 6° C, the temperature controller compensated for changes in yarn denier due to changes in process variables up to approximately ±81 denier. When changes in process variables caused changes in yarn denier in excess of approximately ±81 denier, the yarn plug failed to oscillate across the electric eye beam. The temperature limits of the by-pass circuit of the temperature controller were determined by the desired denier limits of the yarn. Since the temperature relationship between the crimped polypropylene yarn and the draw roll was approximate, a conservative setting for the by-pass circuit was used.

Out of a total of 910 packages of yarn produced, seven "short" packages were produced, that is the timer timed out seven times due to a failure of the yarn plug to oscillate properly, causing the cutter to cut the yarn before the packages were full and thus producing seven "short" packages. A quality control check of these packages proved that the yarn was in fact off-denier. The remaining 903 full packages were deniered and all 903 packages were within the quality control limits.

It is noted that in this example the yarn plug oscillated approximately every 20 seconds in normal operation. The maximum time that could be allowed for the oscillations and still produce on-denier yarn is not known. Depending on the particular process involved, the fixed time period is usually in the range of from about ½ to 5 minutes.

In addition, another 288 full packages of yarn as above described were made in a subsequent mill run. The packages were not deniered, but the packages of yarn produced excellent carpet without streaks or other similar discrepancies which usually indicate off-denier yarn.

These actual runs are evidence of the outstanding results obtained by the practice of the present invention. They also indicate that deniering of full packages of yarn produced in accordance with the present invention can be eliminated without a compromise in quality.

What is claimed is:

1. A method for processing thermoplastic yarn comprising:

continuously monitoring a value which is related to the denier of said yarn and associated with a yarn plug to determine whether said value is above or below a predetermined value;

timing the interval for the monitored value of said yarn plug to oscillate with respect to said predetermined value;

comparing said timed interval with a fixed period of time; and processing the yarn in response to said comparison, thereby maintaining the denier of said yarn within quality control limits.

2. The method of claim 1 wherein said yarn is taken from the group of polyolefins, polyamides and polyesters.

3. The method of claim 1 wherein said yarn is polypropylene.

4. The method of claim 1 wherein said predetermined value is a length of yarn plug and the length is monitored by detecting the presence and absence of the yarn plug at a fixed point.

5. Apparatus for processing thermoplastic yarn comprising:

monitoring means for continuously monitoring a value which is related to the denier of said yarn and associated with a yarn plug to determine whether said value is above or below a predetermined value;

timing means to time the interval for the monitored value of said yarn plug to oscillate with respect to said predetermined value; and means activated by said timing means in response to said time interval as an indication of whether the denier of said yarn is within quality control limits.

6. The apparatus of claim 5 wherein said means activated by said timing means is means for sending said yarn to waste where said time interval is at least equal to a fixed time period and means for packaging said yarn where said time interval is below said fixed time period.

7. The apparatus of claim 6 wherein said fixed time period is in the range of from about ½ to 5 minutes.

8. A method for processing thermoplastic yarn comprising:

continuously monitoring the presence or absence of a yarn plug at a point;

timing the interval subsequent to detection of said yarn plug until the next detection;

cutting the yarn and sending it to waste if the time interval for said detection is at least equal to a fixed time period; and packaging the yarn if the time interval for said detection is less than said fixed time period.

9. The method of claim 8 wherein said thermoplastic yarn is polypropylene.

10. Apparatus for processing thermoplastic yarn comprising:

an electric eye to detect the presence or absence of a yarn plug at a point;

a timer to time the interval subsequent to detection until the next detection;

a cutting means to cut the yarn and send said yarn to waste wherein said time interval is at least equal to a fixed time period; and packaging means for packaging said yarn wherein said time interval is less than said fixed time period.

11. A method for processing thermoplastic yarn comprising:

continuously monitoring a value which is related to the denier of said yarn and associated with a yarn plug to determine whether said value is above or below a predetermined value;

timing the interval for the monitored value of said yarn plug to oscillate with respect to said predetermined value; and processing the yarn in response to said time interval by sending said yarn to waste if said time interval is at least equal to a fixed time period and packaging said yarn where said interval is below said fixed time period, thereby maintaining the denier of said packaged yarn within quality control limits.

12. The method of claim 11 wherein the said fixed time period is in the range of from about ½to 5 minutes.

13. A method for processing thermoplastic yarn comprising:

passing a yarn to a heating zone;

passing the heated yarn to a texturing zone wherein the textured yarn exits the texturing zone in the form of a yarn plug, said yarn plug having an end from which the textured yarn is pulled, said end oscillating with respect to a predetermined point;

controlling the temperature of the heated yarn by controlling the temperature of the heating zone;

controlling the temperature of the heating zone by employing a temperature controller which maintains the temperature of the heating zone at or above a first set point;

continuously monitoring the presence or absence of said yarn plug at the predetermined point;

timing the interval for the end of said yarn plug to oscillate with respect to said predetermined point;

comparing the time interval with a fixed time period; and changing the set point of said temperature controller from the first set point to the second set point in response to the comparison of said time interval with said fixed time period.

14. The method of claim 13 wherein the yarn is selected from the group consisting of polyolefins, polyamides and polyesters.

15. The method of claim 13 wherein the yarn is polypropylene.

16. The method of claim 13 wherein the fixed time period ranges from about ½to about 5 minutes, and wherein the presence or absence of said yarn plug is monitored using an electric eye.

17. The method of claim 16 wherein the second set point is higher than the first set point if the electric eye detects the presence of the yarn plug at the predetermined point for a time interval longer than the fixed time period or wherein the second set point is lower than the first set point if the electric eye detects the absence of the yarn plug at the predetermined point for a time interval longer than the fixed time period.

18. The method of claim 17 wherein the difference between the second set point and the first set point ranges from about 1° to about 10° C.

19. The method of claim 13 wherein the yarn is cut and sent to waste if the time interval for the end of said yarn plug to oscillate with respect to said predetermined point is equal to or longer than the fixed time period with the set point of the temperature controller changed to the second set point.

20. Apparatus for processing thermoplastic yarn comprising heating means for heating a yarn;

texturing means for texturing the heated yarn to produce a yarn plug, said yarn plug having an end from which the textured yarn is pulled;

temperature control means for maintaining the temperature of the heating means at or above a first set point;

monitoring means for monitoring the end of said yarn plug, the end of said yarn plug oscillating with respect to a predetermined point;

timing means for timing the interval for the end of said yarn plug to oscillate with respect to said predetermined point; and means for changing the set point of the temperature control means from the first set point to a second set point if the interval for the end of said yarn plug to oscillate with respect to said predetermined point is equal to or longer than a fixed time period.

21. The apparatus of claim 20 wherein the heating means is a set of draw rolls, the texturing means is a fluid jet and the monitoring means is an electric eye which detects the presence or absence of the yarn plug at a predetermined point.

22. The apparatus of claim 21 wherein the second set point is higher than the first set point if the electric eye detects the presence of the yarn plug at the predetermined point for a time interval equal to or longer than the fixed time period or wherein the second set point is lower than the first set point if the electric eye detects the absence of the yarn plug at the predetermined point for time interval equal to or longer than the fixed time period.

23. The apparatus of claim 22 wherein the difference between the second set point and the first set point ranges from about 1° to about 10° C.

24. The apparatus of claim 20 including means for cutting the yarn and sending it to waste if the interval for the end of said yarn plug to oscillate with respect to said predetermined point is equal to or longer than the fixed time period with the set point of the temperature controller adjusted to the second set point.

* * * * *